US007857034B2

(12) United States Patent
Chou

(10) Patent No.: US 7,857,034 B2
(45) Date of Patent: Dec. 28, 2010

(54) SIDE COVER OF A ROLLER BLIND FRAME RAIL

(76) Inventor: Tser Wen Chou, 1A, 3F., No. 176, Jiankang Rd., Taipei City (TW)

( * ) Notice: Subject to any disclaimer, the term of this patent is extended or adjusted under 35 U.S.C. 154(b) by 220 days.

(21) Appl. No.: 12/350,562

(22) Filed: Jan. 8, 2009

(65) Prior Publication Data

US 2010/0024993 A1 Feb. 4, 2010

(30) Foreign Application Priority Data

Jul. 30, 2008 (TW) ..... 97213505 U

(51) Int. Cl.
*E06B 9/17* (2006.01)

(52) U.S. Cl. ..... 160/323.1; 160/903

(58) Field of Classification Search ..... 160/323.1, 160/903, 23.1, 31, 173 V, 178.1 V, 310; 248/267, 248/268, 269, 270
See application file for complete search history.

(56) References Cited

U.S. PATENT DOCUMENTS 3,854,517 A * 12/1974 Nakamura ..... 160/323.1
4,234,032 A * 11/1980 Stark ..... 160/26
4,448,233 A * 5/1984 Rombouts ..... 160/319
4,492,261 A * 1/1985 Chong ..... 160/319
4,782,887 A * 11/1988 Jones et al. ..... 160/310
4,834,164 A * 5/1989 Tuhey, Jr. ..... 160/319
5,092,389 A * 3/1992 Tedeschi ..... 160/321
5,137,073 A * 8/1992 Huang ..... 160/321
6,415,845 B2 * 7/2002 Cattaneo ..... 160/323.1
6,510,886 B2 * 1/2003 Bettio et al. ..... 160/318
7,017,644 B1 * 3/2006 Kraeutler ..... 160/271

* cited by examiner

*Primary Examiner*—David Purol
(74) *Attorney, Agent, or Firm*—Ming Chow; Sinorica, LLC

(57) ABSTRACT

A side cover of a roller blind frame rail for closing an opening of a tail end of the roller blind frame rail. The side cover includes: a closing board as a main body, the closing board having a fixing rest shelf perpendicularly projecting from the closing board and positioned adjacent to an upper edge thereof, two vertical breaking flutes being respectively formed on two sides of an inner face of the closing board, the breaking flutes extending through the closing board from a lower edge of the closing board to the upper edge thereof; a locating post projecting from a center of the inner face of the closing board; and three insertion plates perpendicularly projecting from the inner face of the closing board. The three insertion plates are a transverse insertion plate and two vertical insertion plates.

4 Claims, 9 Drawing Sheets

SIDE COVER OF A ROLLER BLIND FRAME RAIL

BACKGROUND OF THE INVENTION

The present invention is related to a side cover of a roller blind frame rail for closing an opening of a tail end of the roller blind frame rail.

A conventional roller blind frame rail has two ends each formed with an opening. In general, two side covers are respectively fitted with the two ends to close the openings. When fixing the roller blind on an inner window frame or an outer window frame, it is necessary to first fix a fixing seat on a suitable portion of the inner window frame or outer window frame for fixing the roller blind frame rail. Then the roller blind can be mounted. However, the inner window frame or outer window frame generally has different plane faces for locking the fixing seat thereon. Therefore, when changing the installation position of the conventional roller blind, many different fixing seats are needed for fixing the roller blind. This leads to waste and makes it inconvenient to install the roller blind.

SUMMARY OF THE INVENTION

It is therefore a primary object of the present invention to provide a side cover of a roller blind frame rail for closing an opening of a tail end of the roller blind frame rail. The side cover also serves to fix the roller blind frame rail on a window frame.

It is a further object of the present invention to provide the above side cover of the roller blind frame rail, in which two breaking flutes are respectively formed on two sides of an inner face of the closing board. The closing board can be broken apart along a breaking flute to form a plane edge for snugly attaching to the window frame.

It is still a further object of the present invention to provide the above side cover of the roller blind frame rail, in which three insertion plates perpendicularly project from the closing board for tightly connecting the closing board with the frame rail to close the opening thereof.

It is still a further object of the present invention to provide the above side cover of the roller blind frame rail, in which the three insertion plates are a transverse insertion plate and two vertical insertion plates. Two arced guide walls are formed on the inner face of the closing board. The arced guide walls curvedly outward extend from inner sides of the vertical insertion plates respectively for enlarging operation angle of a bead chain and facilitating operation thereof.

It is still a further object of the present invention to provide the above side cover of the roller blind frame rail, in which the three insertion plates restrict the bead chain within a space so as to avoid detachment thereof.

The present invention can be best understood through the following description and accompanying drawings wherein:

DETAILED DESCRIPTION OF THE PREFERRED EMBODIMENTS

Figure 1:
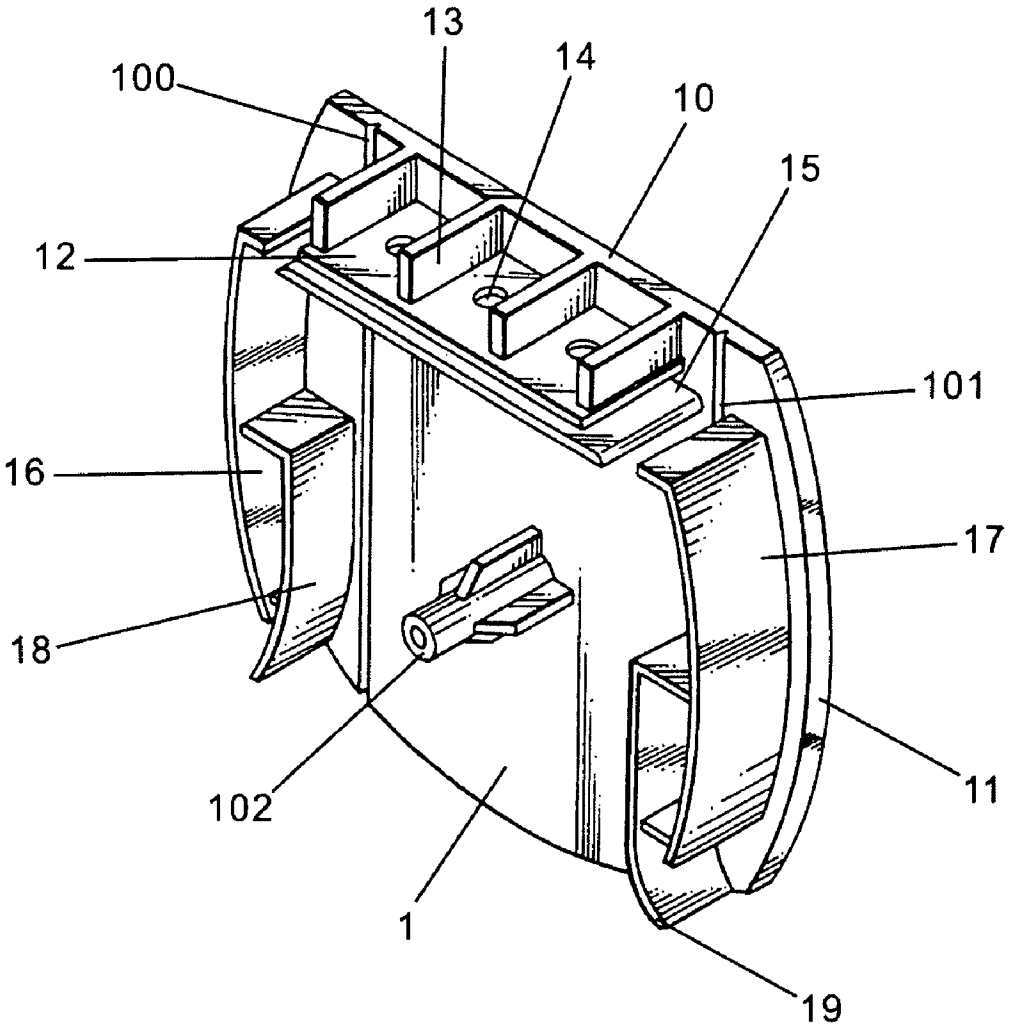
FIG. 1 is a perspective view of the present invention.
Figure 2:
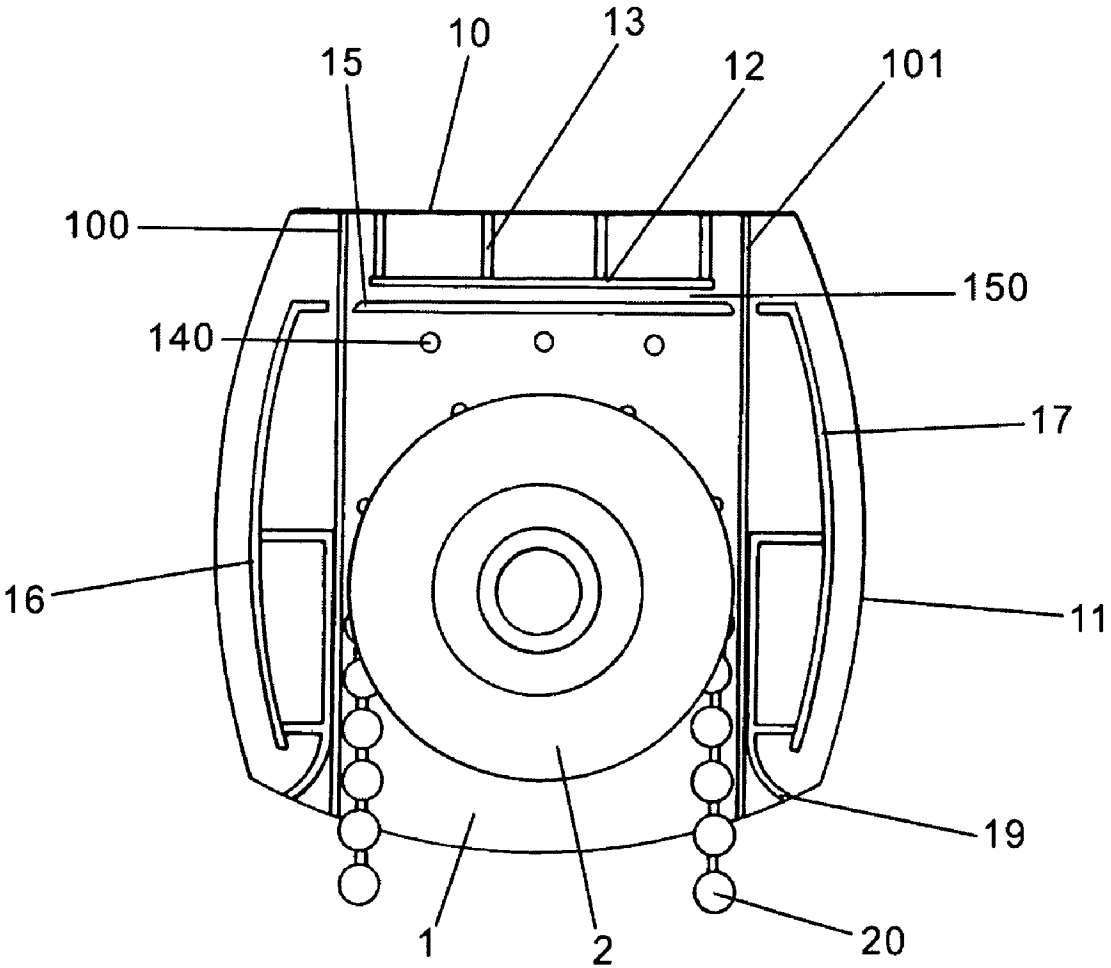
FIG. 2 is a front view of the present invention.

Please refer to FIGS. 1 and 2. According to a preferred embodiment, the side cover of the present invention includes a closing board 1 as a main body. The closing board 1 has an upper edge, which is a plane face 10. The closing board 1 further has two lateral sides respectively downward extending from two ends of the plane face 10. The lateral sides are two arced sides 11. An inner face of the closing board 1 is formed with two vertical breaking flutes 100, 101 where the closing board 1 has thinner thickness. The breaking flutes 100, 101 extend through the closing board 1 from a lower edge of the closing board 1 to the upper edge thereof to divide the closing board 1 into three blocks. In addition, a fixing rest shelf 12 perpendicularly projects from the inner face of the closing board 1 and is positioned adjacent to the upper edge thereof. Several reinforcing ribs 13 and through holes 14 are formed on a body of the fixing rest shelf 12. Multiple locating threaded holes 140 are formed on the closing board 1 under the fixing rest shelf 12. Screws can be screwed through the locating threaded holes 140 to fix the closing board 1. A locating post 102 perpendicularly projects from a center of the inner face of the closing board 1. Three insertion plates perpendicularly project from the inner face of the closing board 1 and are positioned on the three blocks thereof respectively. The three insertion plates are a transverse insertion plate 15 corresponding to the fixing rest shelf 12 and two vertical insertion plates 16, 17. The transverse insertion plate 15 is spaced from the fixing rest shelf 12 by a gap 150 for accommodating a frame rail 3 therein (as shown in FIG. 2). The vertical insertion plates 16, 17 have arced configurations corresponding to the arced profiles of the arced sides 11. In addition, two arced guide walls 18, 19 are formed on a lower section of the inner face of the closing board 1. The arced guide walls 18, 19 curvedly outward extend from inner sides of the vertical insertion plates 16, 17 respectively. A bead chain wheel 2 for a bead chain 20 can be fitted on the locating post 102 and restricted by the three insertion plates 15, 16 and 17 to avoid detachment of the bead chain 20 (as shown in FIG. 2).

Figure 3:
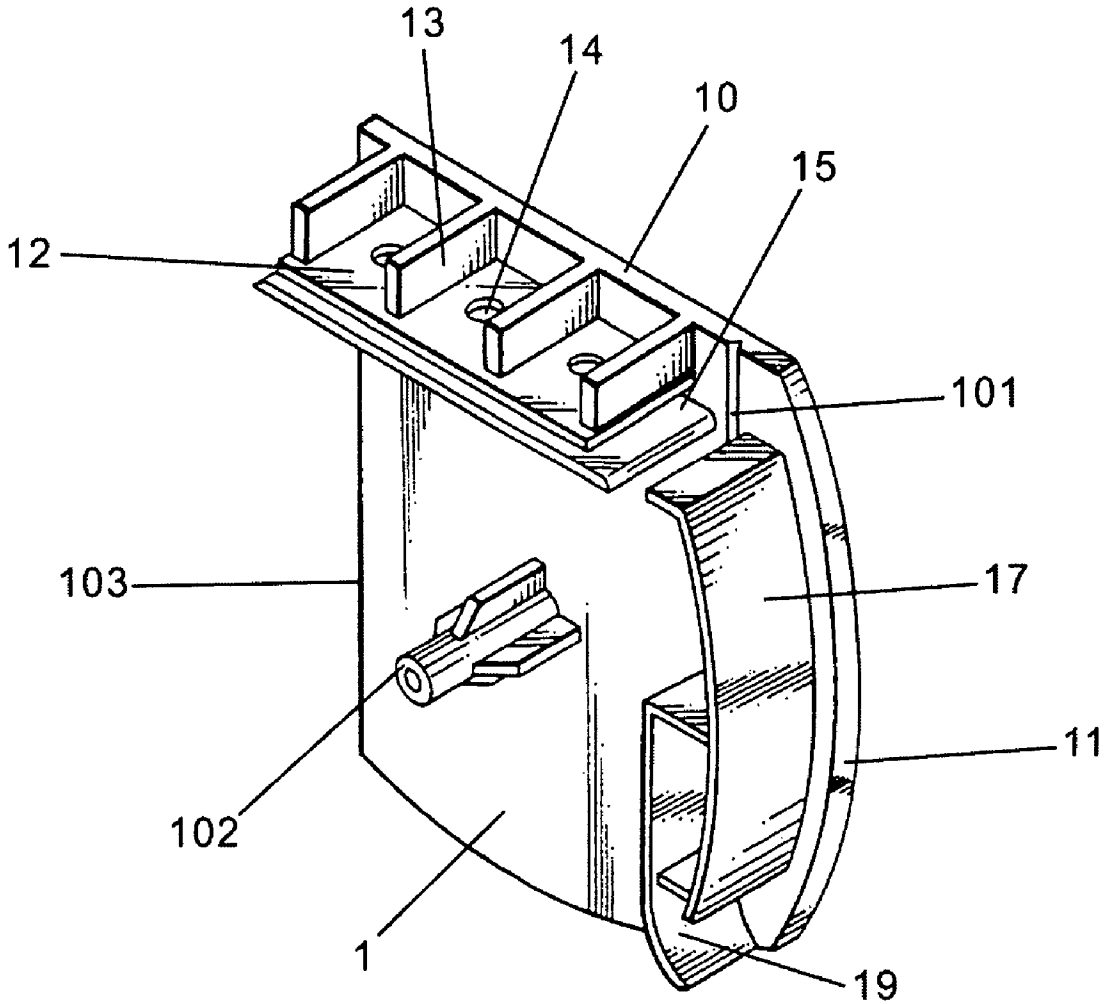
FIG. 3 is a perspective view according to FIG. 1, showing that one of the blocks of the closing board is removed.
Figure 4:
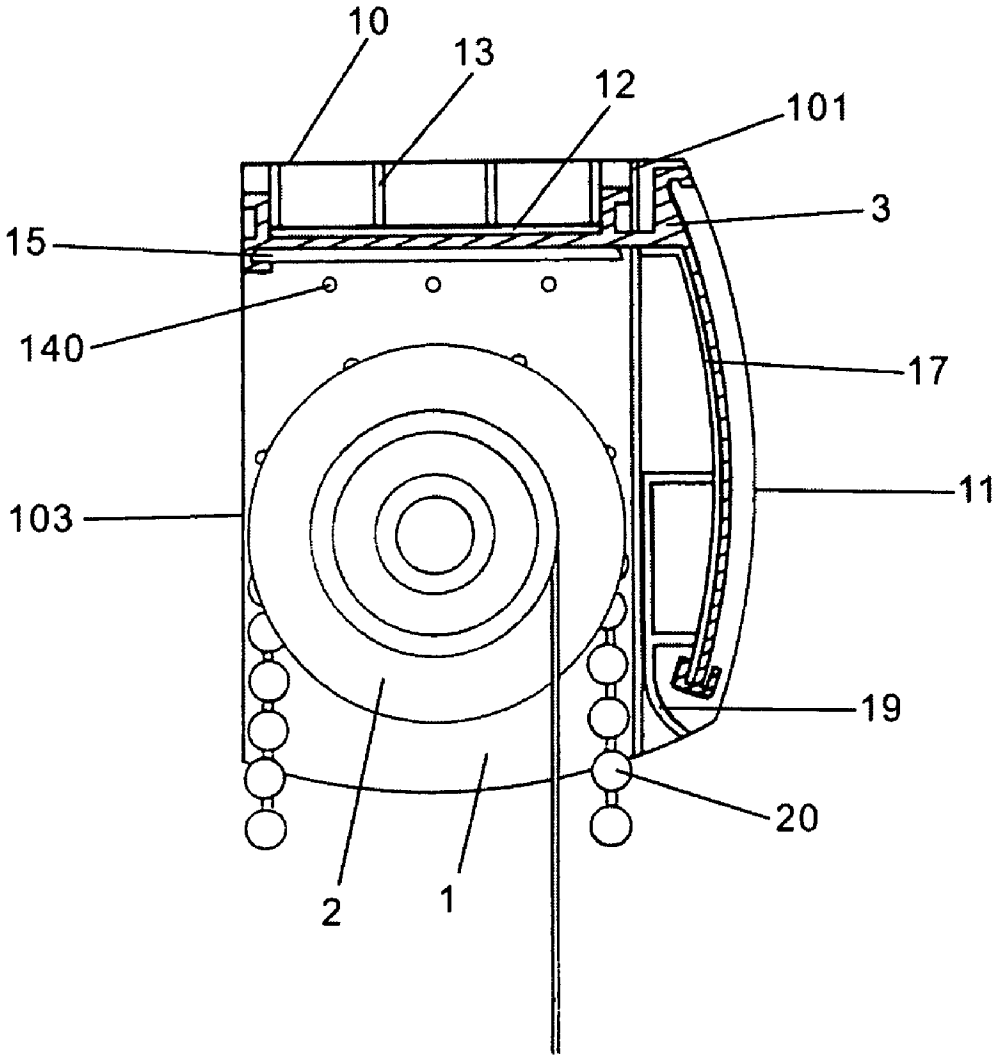
FIG. 4 is a front view of the present invention, showing the arrangement of the components of the present invention.
Figure 5:
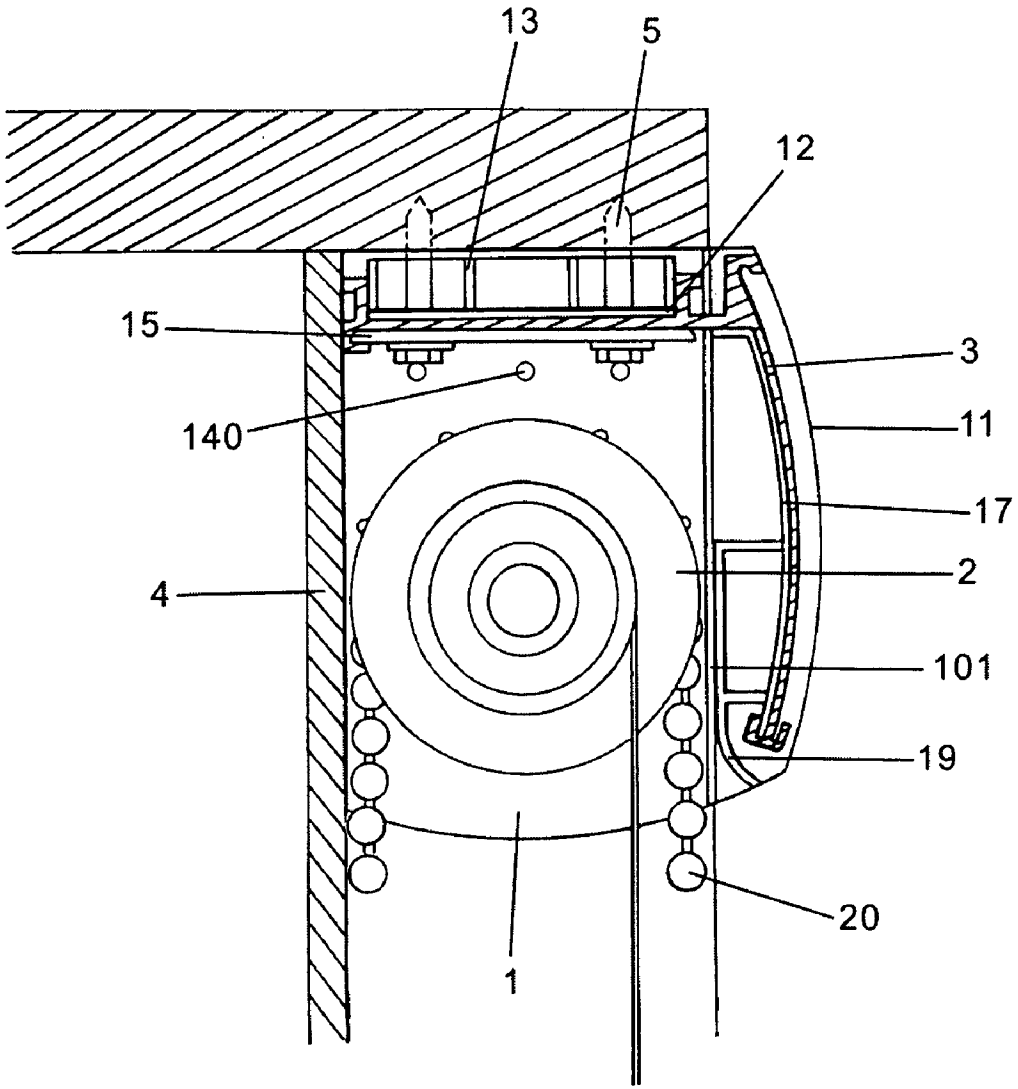
FIG. 5 is a front view of the present invention, showing an installation manner of the present invention.

Please now refer to FIGS. 3, 4 and 5. When installing the roller blind, the closing board 1 is first broken apart along a breaking flute 100 to remove a block and form a plane edge 103 for snugly attaching to a window frame. The bead chain wheel 2 is fitted on the locating post 102 of the closing board 1 to connect a blind shade with the closing board 1. Then the frame rail 3 is inserted into the gap 150 between the insertion plate 15 and the fixing rest shelf 12 and connected with the closing board 1 to form the roller blind (as shown in FIG. 4). When mounting the roller blind on a window, the plane edge 103 is directly attached to the window frame 4 with the upper plane face 10 of the closing board 1 attaching to an inner side of the window frame. Then the screws 5 are passed through the through holes 14 of the fixing rest shelf 12 and screwed into a window frame mount to fix the roller blind (as shown in FIG. 5).

Figure 6:
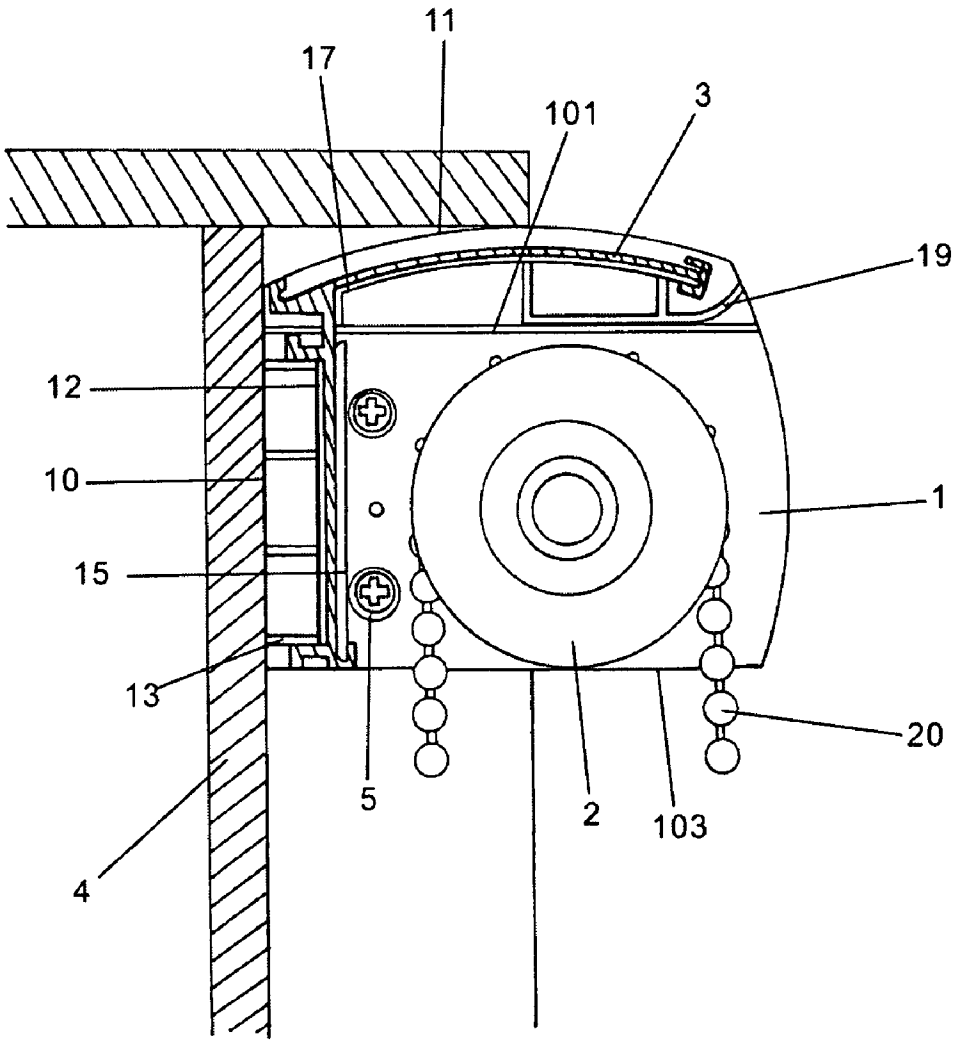
FIG. 6 is a front view of the present invention, showing another installation manner of the present invention.
Figure 7:
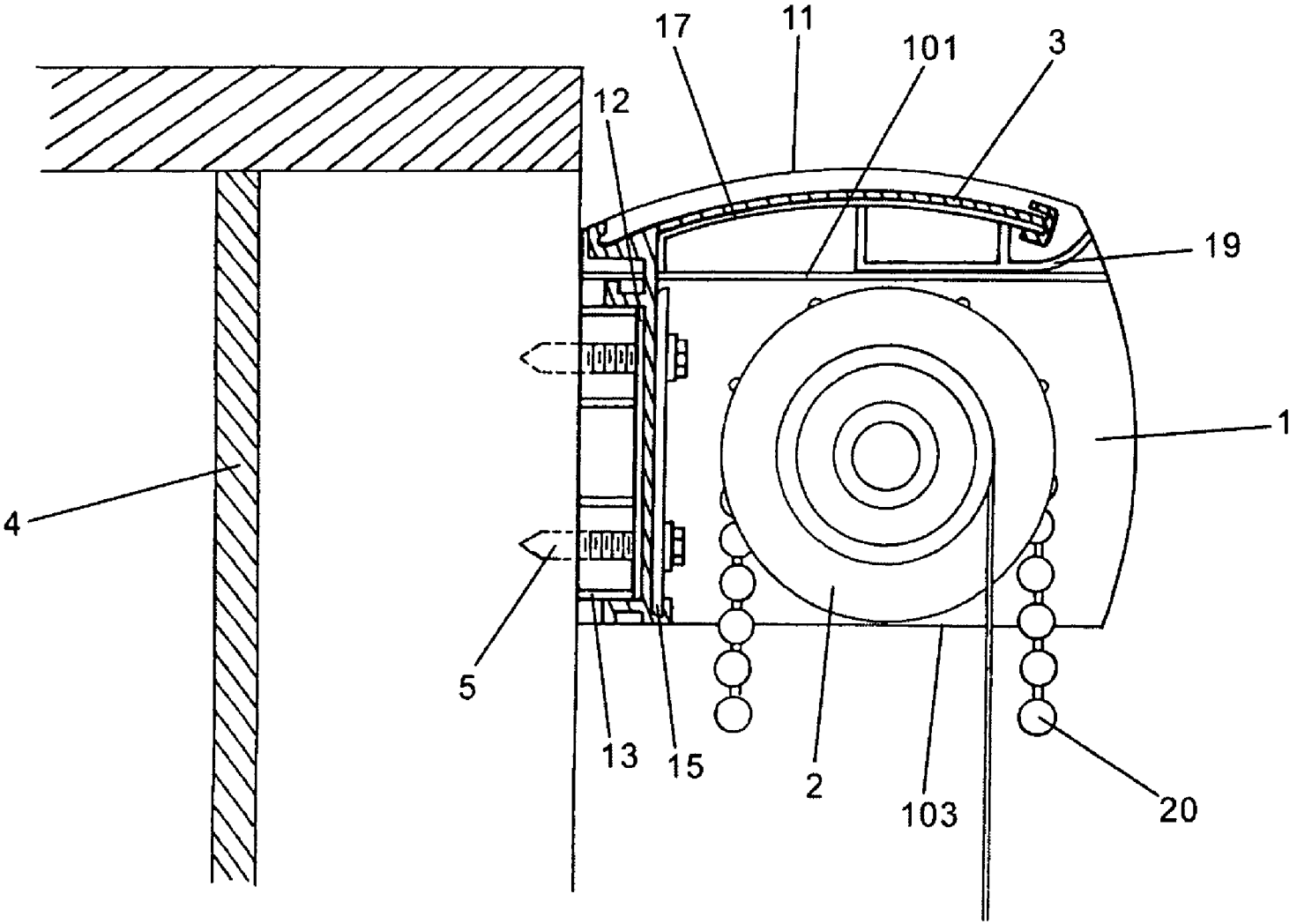
FIG. 7 is a front view of the present invention, showing still another installation manner of the present invention.

FIGS. 6 and 7 respectively show two other ways to install the present invention. In FIG. 6, the upper plane face 10 of the closing board 1 is directly attached to the window frame 4 and the screws 5 are screwed through the locating threaded holes 140 of the closing board 1 to fix the closing board 1 on inner side of the window frame. This makes the blind shade closer to the window frame to enhance shading effect. In FIG. 7, the upper plane face 10 of the closing board 1 is attached to an outer window frame and the screws 5 are passed through the insertion plate 15 and the fixing rest shelf 12 and screwed into the outer window frame to fix the closing board 1 and directly connect the frame rail 3 therewith. In this state, the roller blind is fixed on the outer window frame.

Figure 8:
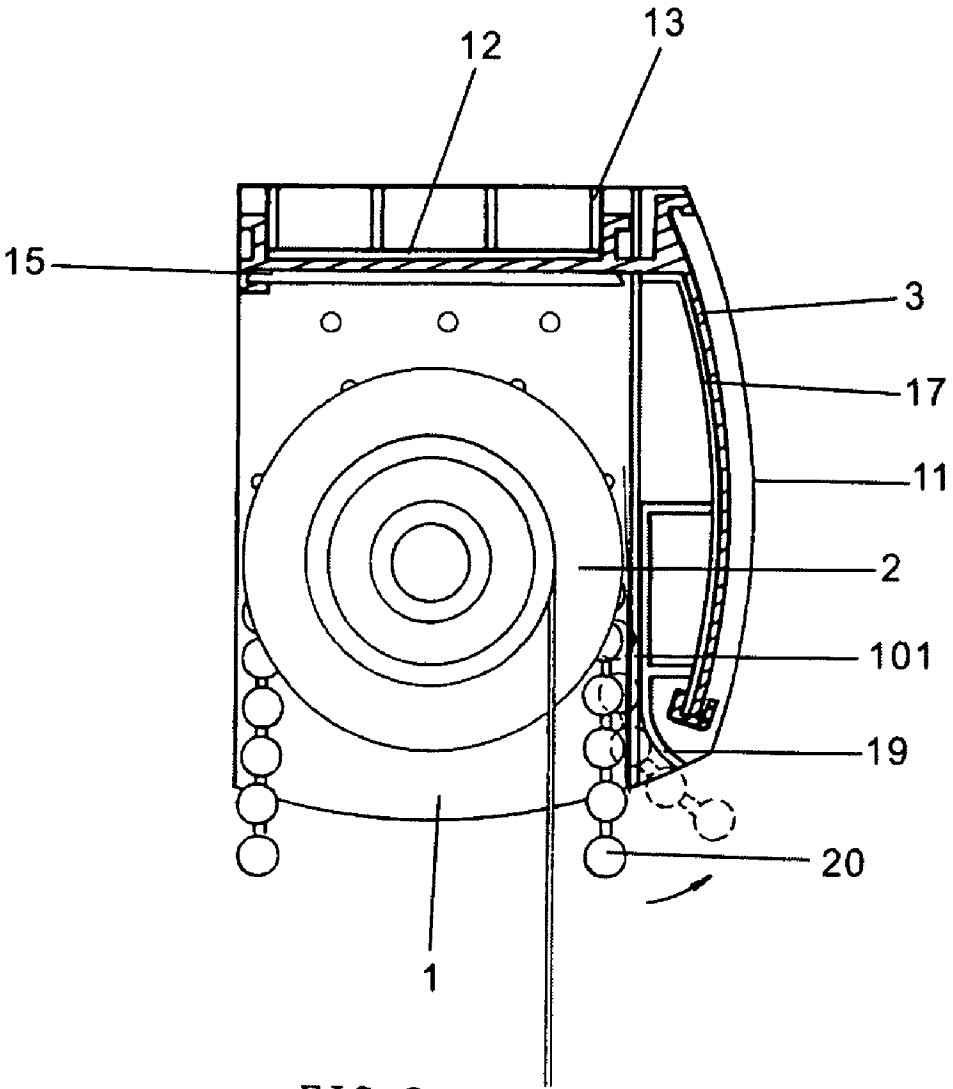
FIG. 8 is a front view of the present invention, showing the operation of the present invention.
Figure 9:
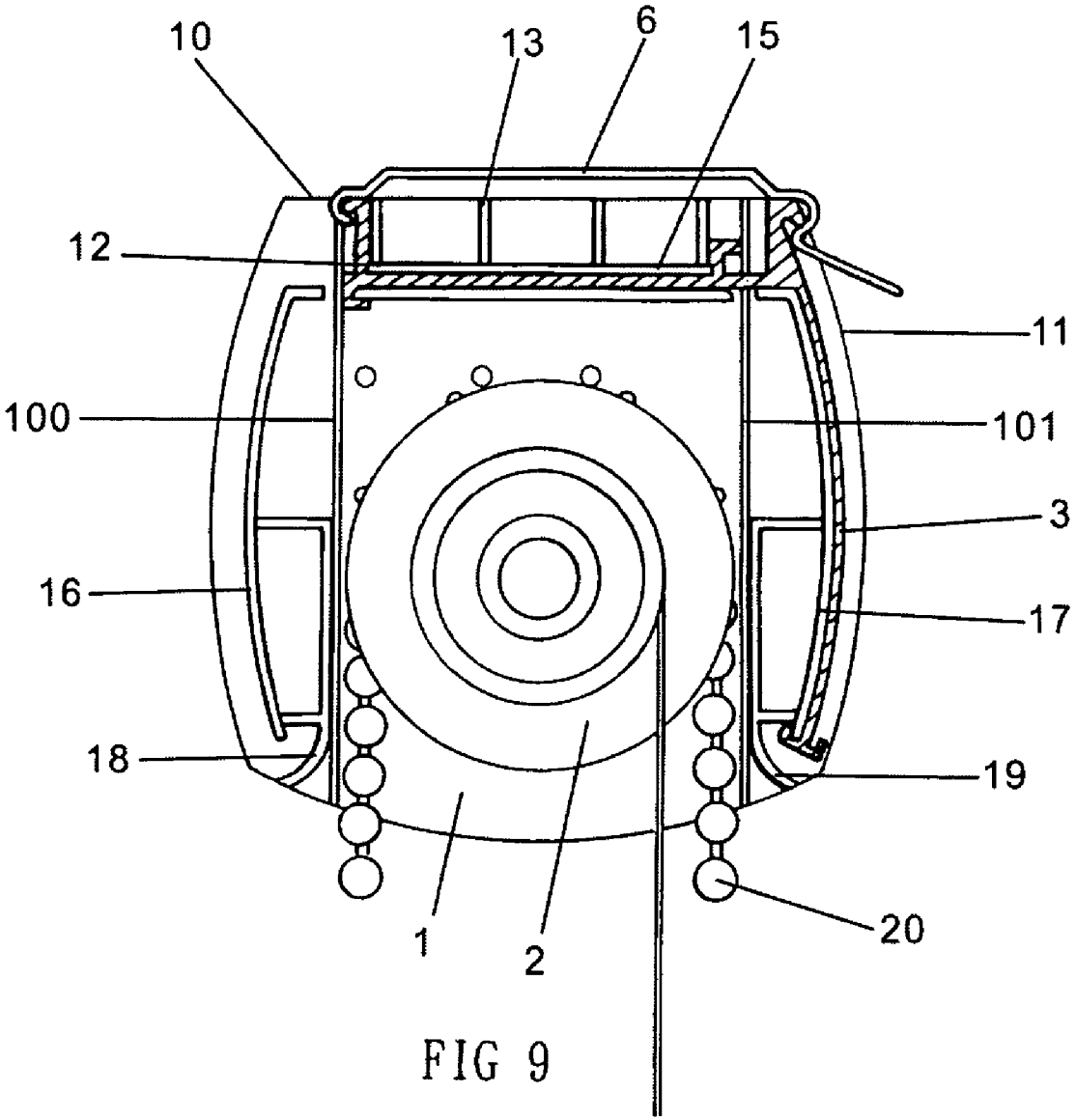
FIG. 9 is a front view of the present invention, showing still another installation of the present invention.

In the case that there is furniture under the roller blind and the operation room for the bead chain 20 is insufficient, the outward curved arced guide walls 18, 19 enable a user to conveniently operate the bead chain 20 at high angle (as shown in FIG. 8). FIG. 9 shows another embodiment of the present invention, in which a fixing clip 6 is used to clip front end and rear end of the frame rail 3 to directly detachably mount the roller blind under a ceiling. When it is desired to take off the roller blind, a user can directly bias the fixing clip 6 to remove the roller blind.

The above embodiments are only used to illustrate the present invention, not intended to limit the scope thereof. Many modifications of the above embodiments can be made without departing from the spirit of the present invention.

What is claimed is:

1. A side cover of a roller blind frame rail for closing an opening of a tail end of the roller blind frame rail, the side cover comprising:

a closing board as a main body, the closing board having an upper edge having a plane face, the closing board further having two arced sides respectively downward extending from two ends of the plane face, a fixing rest shelf perpendicularly projecting from the closing board and positioned adjacent to the upper edge thereof, an inner face of the closing board being formed with two vertical breaking flutes where the closing board has thinner thickness, the breaking flutes extending through the closing board from a lower edge of the closing board to the upper edge thereof to divide the closing board into three blocks;

a locating post projecting from a center of the inner face of the closing board, a fixed end of the locating post being formed with multiple fin sections;

three insertion plates respectively perpendicularly projecting from the three blocks of the closing board, the three insertion plates being a transverse insertion plate and two vertical insertion plates; and two arced guide walls formed on the inner face of the closing board, the arced guide walls curvedly outward extending from inner sides of the vertical insertion plates respectively.

2. The side cover of the roller blind frame rail as claimed in claim 1, wherein several reinforcing ribs are formed on the fixing rest shelf and perpendicularly extend from the upper edge of the closing board, several through holes being formed on the fixing rest shelf between the reinforcing ribs.

3. The side cover of the roller blind frame rail as claimed in claim 1, wherein transverse insertion plate is formed with several through holes corresponding to the through holes of the fixing rest shelf respectively.

4. The side cover of the roller blind frame rail as claimed in claim 1, wherein the insertion plates have a configuration in conformity with a profile of the closing board.

* * * * *